US006499163B1

(12) United States Patent
Stensby

(10) Patent No.: US 6,499,163 B1
(45) Date of Patent: Dec. 31, 2002

(54) APPARATUS CONVERTIBLE TO A CHAIR OR TREATMENT TABLE

(76) Inventor: Harold Stensby, 1663 CR 608, Berryville, AR (US) 72616

( * ) Notice: Subject to any disclaimer, the term of this patent is extended or adjusted under 35 U.S.C. 154(b) by 31 days.

(21) Appl. No.: 09/707,916

(22) Filed: Nov. 8, 2000

(51) Int. Cl.[7] ..... A61G 1/017; A47C 17/16; A47C 1/035

(52) U.S. Cl. ..... 5/618; 5/86.1; 5/614; 5/723; 280/250.1; 297/DIG. 4

(58) Field of Search ..... 5/618, 613, 86.1, 5/722, 723, 691, 614, 611, 11, 81.1 R, 610; 280/250.1; 297/DIG. 4

(56) References Cited

U.S. PATENT DOCUMENTS

| | | | | | |
|---|---|---|---|---|---|
| 710,076 | A | * | 9/1902 | Rosett | 5/723 |
| 1,526,737 | A | * | 2/1925 | Bradley | 5/722 |
| 2,107,205 | A | * | 2/1938 | McLendon | 5/723 X |
| 2,247,667 | A | * | 7/1941 | Rosberger | 5/723 |
| 2,377,649 | A | * | 6/1945 | Quinney | 297/68 |
| 2,383,340 | A | * | 8/1945 | Pezzano | 297/DIG. 4 X |
| 2,706,821 | A | * | 4/1955 | Griggs | 5/723 |
| 2,869,614 | A | * | 1/1959 | Wamsley | 5/86.1 X |
| 2,879,523 | A | * | 3/1959 | Klassen et al. | 5/723 |
| 2,976,912 | A | * | 3/1961 | Dias | 297/DIG. 4 X |
| 3,147,039 | A | * | 9/1964 | Smith et al. | 297/90 |
| 3,284,126 | A | * | 11/1966 | Piazza | 5/614 X |
| 3,308,492 | A | * | 3/1967 | Lovette | 5/722 |
| 4,046,418 | A | * | 9/1977 | Smith et al. | 297/118 |
| 4,079,990 | A | * | 3/1978 | McMunn et al. | 297/69 |
| 4,285,541 | A | * | 8/1981 | Onishi | 297/84 |
| 4,453,732 | A | * | 6/1984 | Assanah et al. | 297/DIG. 4 X |
| 4,545,593 | A | | 10/1985 | Farman | 280/250.1 |
| RE32,242 | E | | 9/1986 | Minnebraker | 280/250.1 |
| 4,632,450 | A | * | 12/1986 | Holdt | 297/84 |
| 4,691,962 | A | * | 9/1987 | Holdt | 297/84 |
| 4,717,169 | A | * | 1/1988 | Shaffer | 280/648 |
| 4,852,899 | A | | 8/1989 | Kueschall | 280/250.1 |
| 4,949,408 | A | * | 8/1990 | Trkla | 5/86.1 |
| 4,968,050 | A | * | 11/1990 | Kendrick et al. | 280/250.1 |
| 5,050,899 | A | | 9/1991 | Stensby | 280/250.1 |
| 5,333,887 | A | * | 8/1994 | Luther | 280/250.1 |
| 5,662,345 | A | | 9/1997 | Kiewit | 280/250.1 |
| 5,782,483 | A | | 7/1998 | Rogers et al. | 280/642 |
| 5,868,461 | A | * | 2/1999 | Brotherston | 5/618 X |
| 5,953,779 | A | * | 9/1999 | Schwartz | 5/722 |
| 6,154,899 | A | * | 12/2000 | Brooke et al. | 5/81.1 R |
| 6,185,769 | B1 | * | 2/2001 | Larisey, Jr. et al. | 5/618 X |

OTHER PUBLICATIONS

Stryker Medical, "Stretcher Chair Model 5050".
Hausted, "All Purpose & Specialty Chairs".

* cited by examiner

*Primary Examiner*—Robert G. Santos
(74) *Attorney, Agent, or Firm*—Shlesinger, Arkwright & Garvey LLP

(57) ABSTRACT

An apparatus convertible to a chair or table comprises a support structure; first and second pairs of wheels rotatably supporting the support structure; and a platform supported by the support structure. The platform includes a seat support and a back support. The platform is positionable between a chair configuration and a table configuration. The first pair of wheels have inboard and outboard positions. The first pair of wheels are in the inboard position when the platform is in the table configuration. The first pair of wheels are in the outboard position when the platform is in the chair configuration.

29 Claims, 9 Drawing Sheets

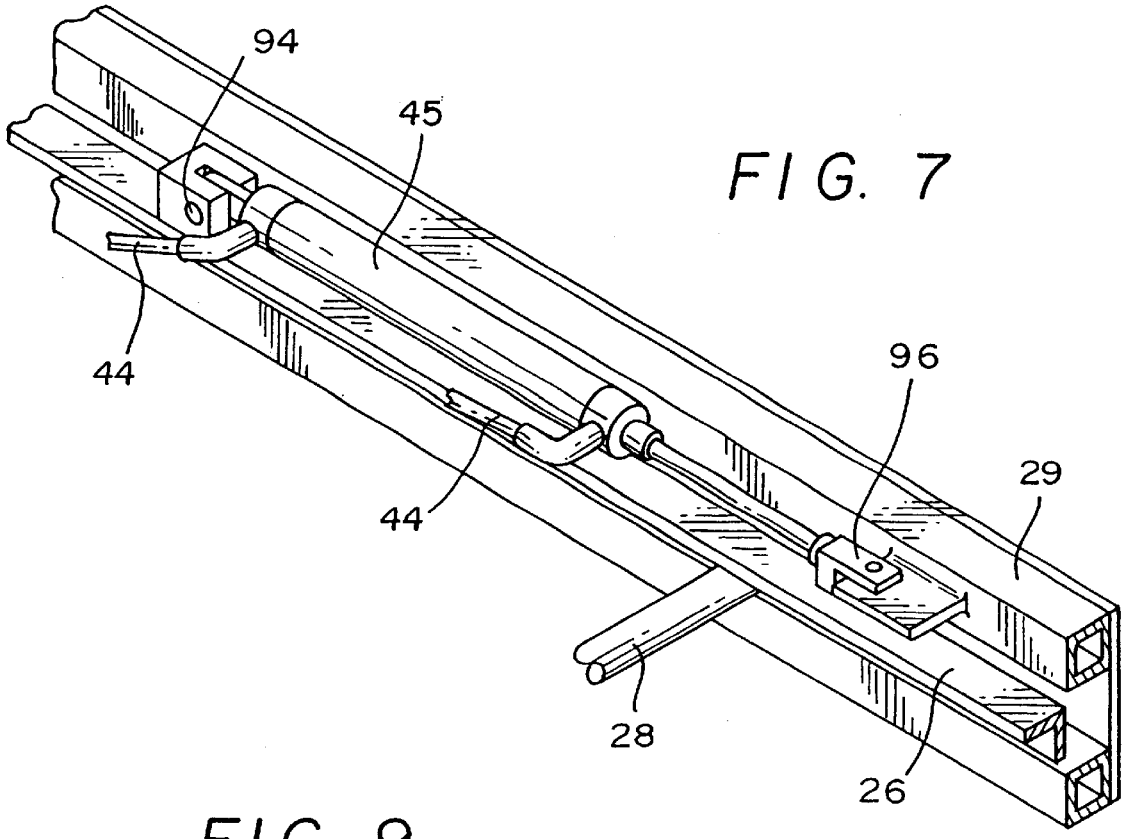
FIG. 7
FIG. 9
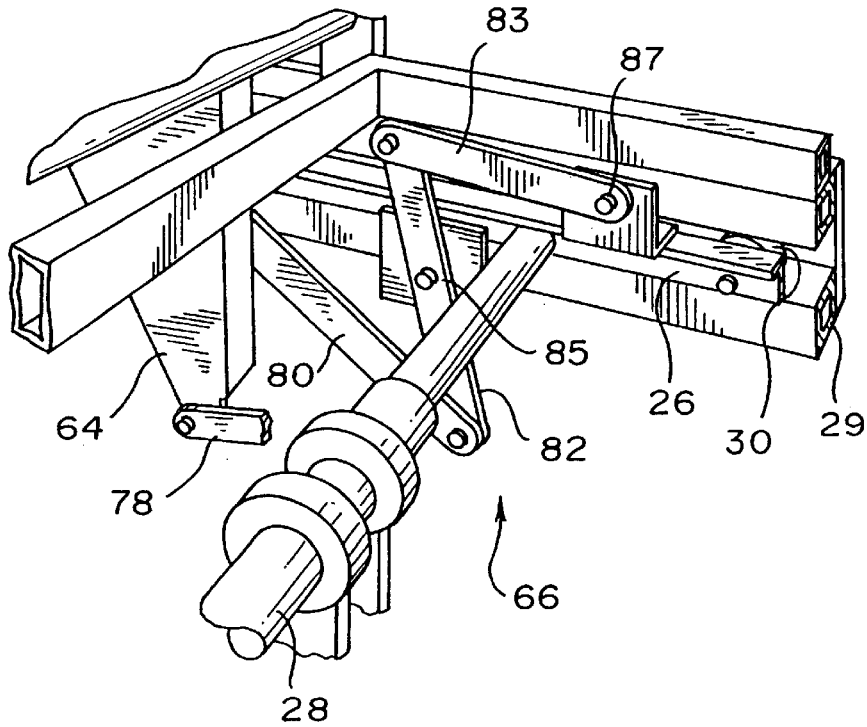

APPARATUS CONVERTIBLE TO A CHAIR OR TREATMENT TABLE

FIELD OF THE INVENTION

The present invention relates generally to an apparatus convertible to a chair or treatment table.

OBJECTS AND SUMMARY OF THE INVENTION

It is an object of the present invention to provide an apparatus convertible to a chair or treatment table that expands its footprint when in the chair configuration to account for shift in the center of gravity of the patient when seated up.

It is another object of the present invention to provide an apparatus convertible to a chair or treatment table that moves the patient to a rearward position when seated up to shift the center of gravity of the patient toward the center of the apparatus.

It is another object of the present invention to provide a split cushion that can be easily removed from underneath a patient lying on a treatment table to expose the underlying firm surface of the table for a medical procedure, such as a CPR.

In summary, the present invention provides an apparatus convertible to a chair or treatment table comprising a support structure; first and second pairs of wheels rotatably supporting the support structure; and a platform supported by the support structure. The platform includes a seat support and a back support. The platform is positionable between a chair configuration and a table configuration. The first pair of wheels have inboard and outboard positions. The first pair of wheels are in the inboard position when the platform is in the table configuration and are in the outboard position when the platform is in the chair configuration.

These and other objects of the present invention will become apparent from the following detailed description.

BRIEF DESCRIPTIONS OF THE DRAWINGS

FIG. 7 is a fragmentary perspective view of a cylinder connected to a stationary frame member and a sliding rail, shown extended when the apparatus is in the chair configuration.

FIG. 9 is a fragmentary perspective view of a linkage mechanism used to move a sliding frame relative to a stationary frame.

Figure 4:
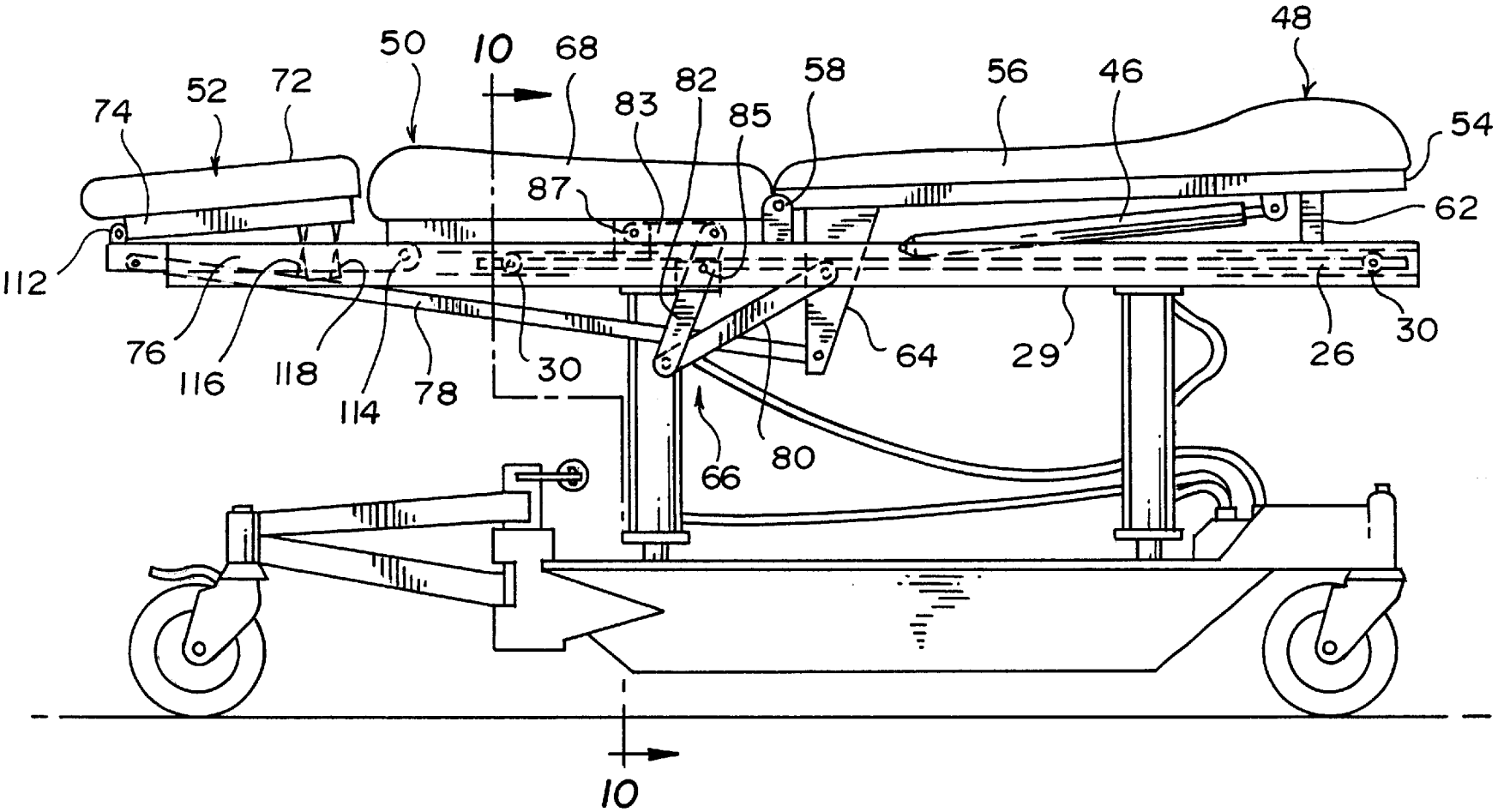
FIG. 4 is a right side elevational view of FIG. 1.

FIG. 10*a* is cross-section view taken along line 10—10 of FIG. 4.

Figure 1:
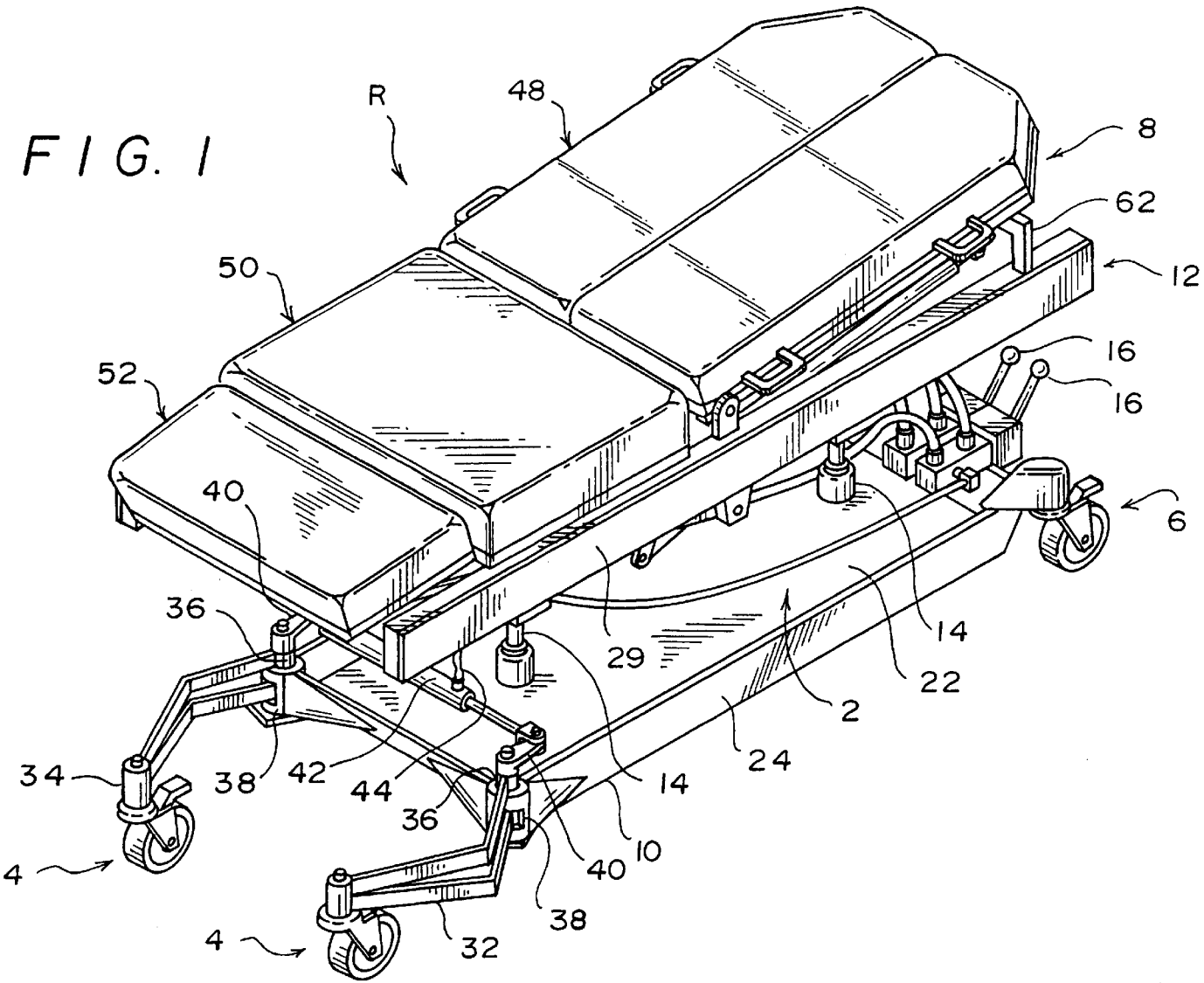
FIG. 1 is a perspective view of an apparatus made in accordance with the present invention. The apparatus is convertible to a chair or treatment table and is shown in a table configuration.
Figure 11:
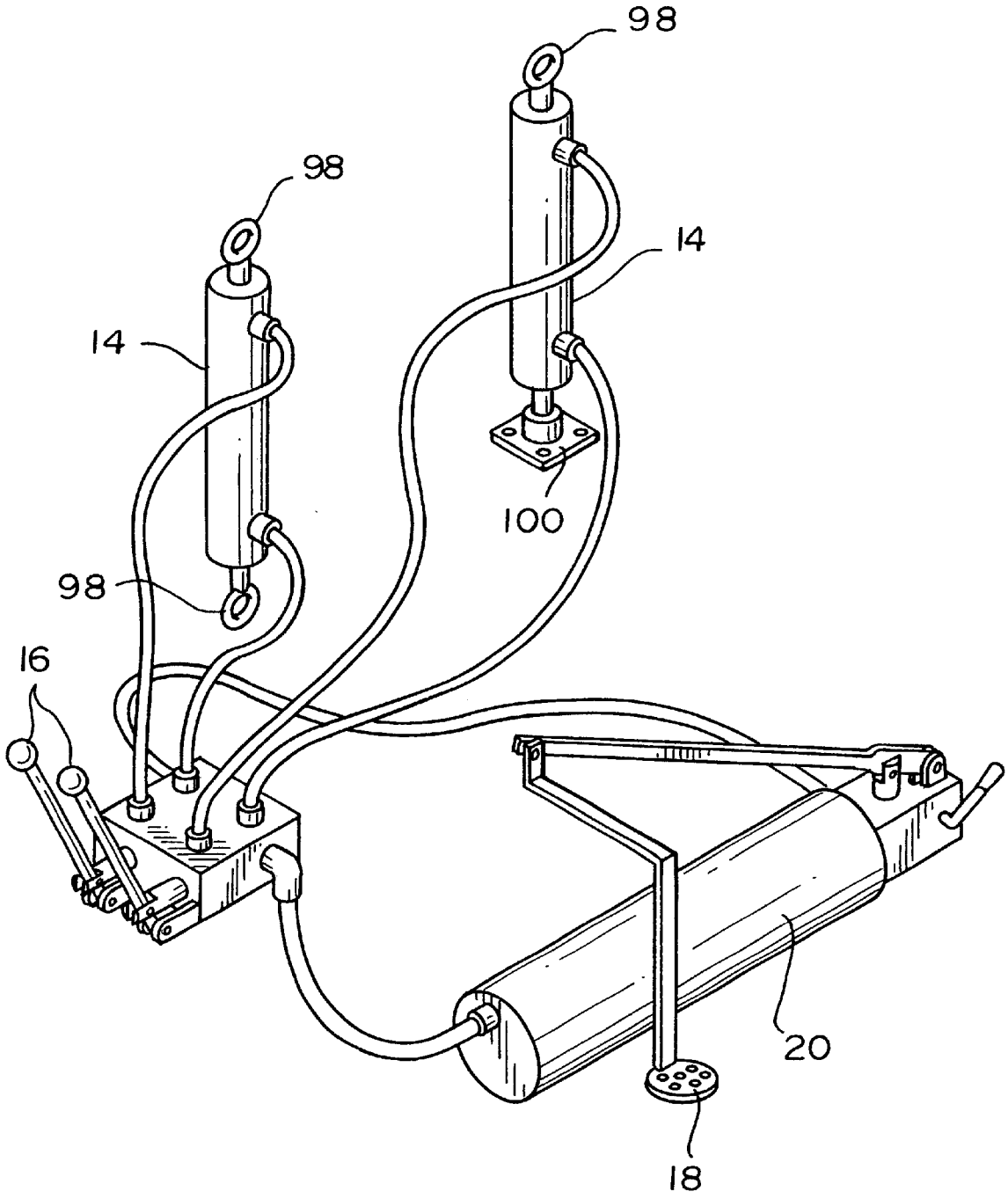

FIG. 11 is a schematic perspective view of a hydraulic system used to raise or lower the platform structure of FIG. 1

Figure 12:
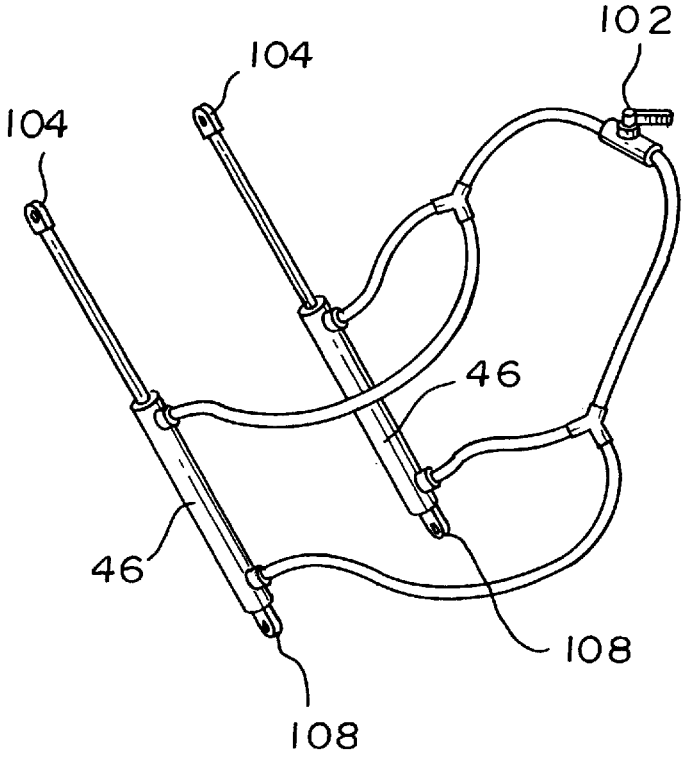

FIG. 12 is a schematic perspective view of a closed loop system used to raise or lower the back support of the apparatus of FIG. 1.

DETAILED DESCRIPTION OF THE INVENTION

An apparatus R convertible to a chair or treatment table is disclosed in FIG. 1. The apparatus R includes a support structure 2 movably supported by a front pair of wheel assemblies 4 and a rear pair of wheel assemblies 6. A platform structure 8 is supported by the support structure 2.

Figure 2:
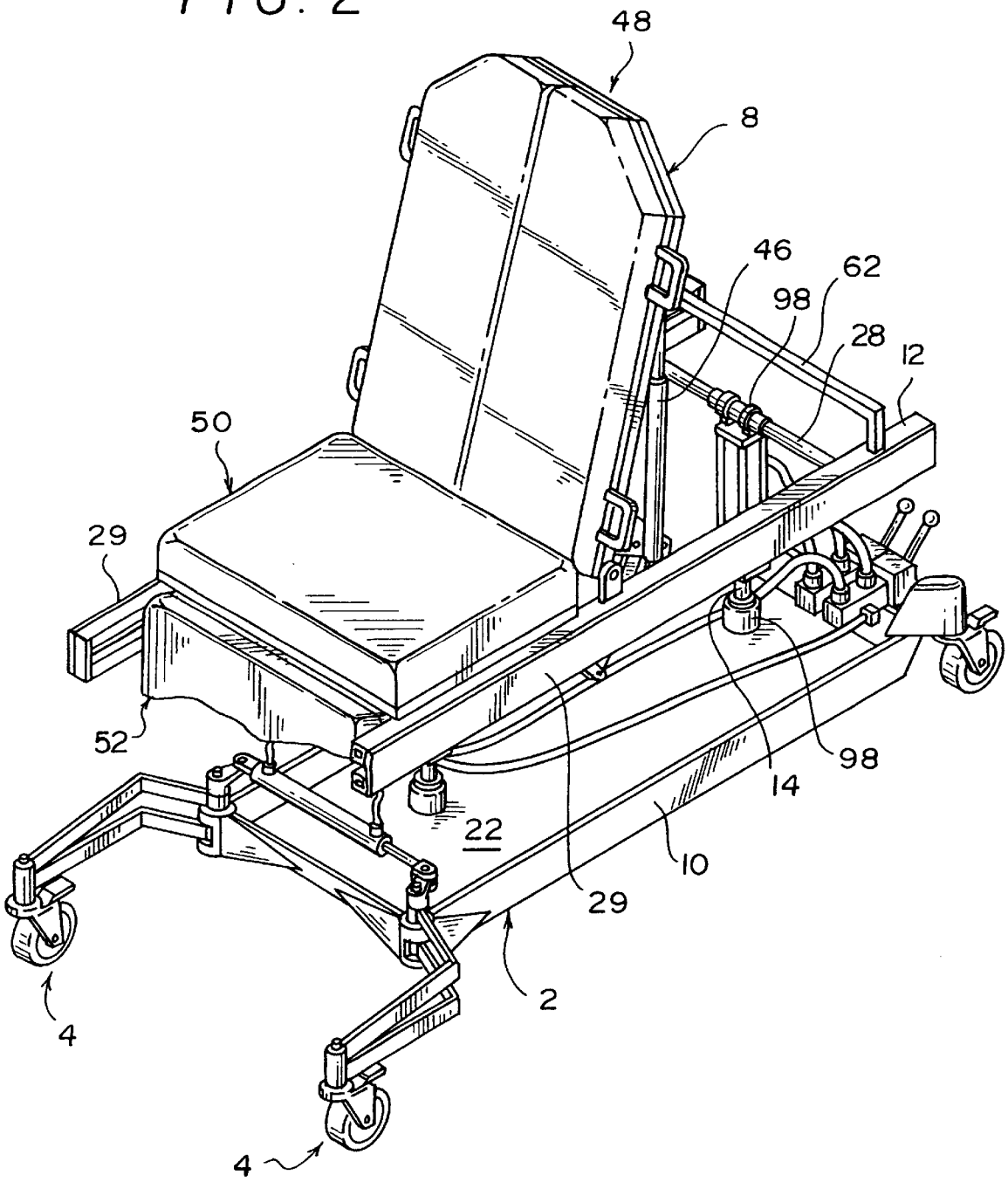
FIG. 2 is a perspective view of the apparatus of FIG. 1, shown in a chair configuration.

The platform structure 8 has a table configuration for supporting a patient in a substantially horizontal position, as best shown in FIG. 1, or a chair configuration for supporting a patient in a seated position, as best shown in FIG. 2. When the platform structure 8 is in the table configuration, the front wheel assemblies 4 are drawn inwardly towards each other. When the platform structure 8 is in the chair configuration, the wheel assemblies 4 are drawn apart from each other to provide a wider footprint, as best shown in FIG. 2. In addition, the platform structure 8 moves towards the rear when in the chair configuration to position the weight of the patient towards the center of the support structure 2.

The support structure 2 comprises a base support 10 and upper support 12 interconnected together by a pair of double-acting cylinders 14, which may be hydraulic or pneumatic. The cylinders may be replaced by substitutes well known in the art, such as motor operated screws. The cylinders 14 are used to raise or lower the upper support 12 when both the cylinders 14 are operated at the same time. The cylinders 14 are also used to tilt the upper support 12 forwardly or backwardly by selectively operating one of the cylinders 14 independently of the other cylinder in a manner well known to a person skilled in the art. For example, if the cylinder 14 nearer the rear wheel assemblies 6 is displaced more than the cylinder 14 nearer the wheel assemblies 4, either downwardly or upwardly, the rear portion of the upper support 12 will either move upwardly or downwardly more than the front portion would move, thereby inclining the upper support 12 (and the platform structure 8 attached thereto) in one direction or the other direction. Control levers 16 operably connected to respective cylinders 14 in a conventional manner provide the means for selectively operating the cylinders 14. A foot pedal 18 (see FIG. 3) is provided for simultaneous operation of the cylinders 14. The pedal 18 is connected to the cylinder circuit in a manner well known to a person skilled in the art. A pump 20 operably connected to the foot pedal 18 is provided to power the cylinders 14.

The base support 10 may be made in any conventional manner. For example, the base support 10 may include a solid plate member 22 joined to a frame structure 24.

The upper support 12 comprises a pair of parallel members 26 interconnected together by a pair of transverse members 28, which are in turn respectively secured to respective cylinders 14. Rollers 30 fixed to the members 26 support a pair of rails 29 in a sliding manner and are used to support the platform structure 8 in a manner that will be described below.

Figure 8:
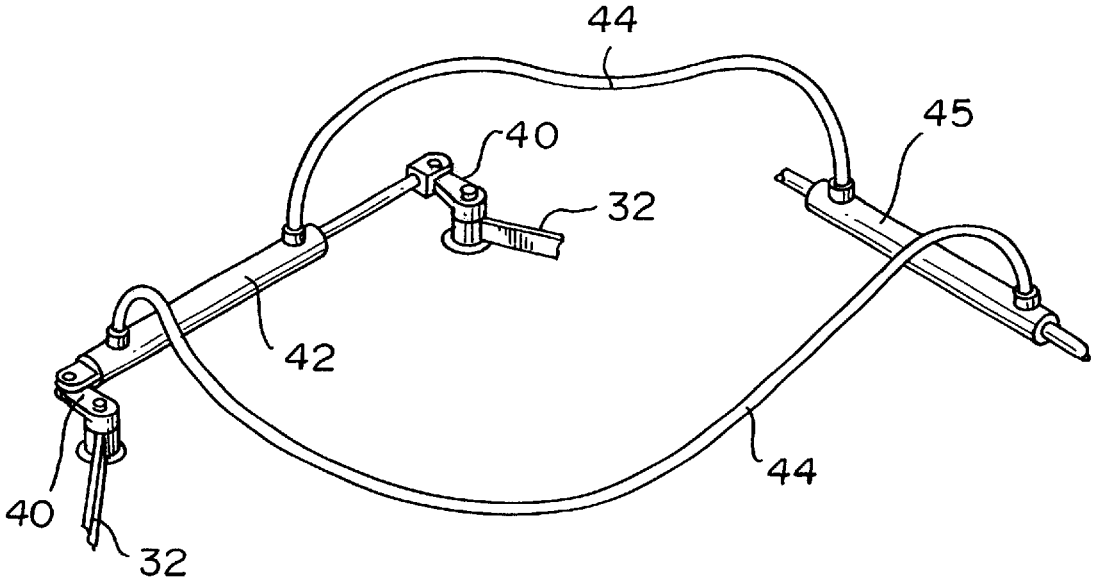
FIG. 8 is a schematic view of a closed loop system used to spread out or draw in the front wheels of the apparatus.

The front wheel assemblies 4 are pivotably connected to the base support 10, as best shown in FIG. 1. Each wheel assembly 4 includes an outwardly extending arm 32, one end of which is connected to a swivel wheel 34 and the other end of which is connected to a pivot rod 36 supported by roller bearings within housing 38. A linkage arm 40 is fixedly secured to respective pivot rod 36 and pivotally connected to a double-acting cylinder 42. Hydraulic lines 44 are operably connected in a conventional manner to a double-acting cylinder 45 (see FIG. 7) which is actuated by the lifting of a back support 48 of the platform structure 8 to an upright position. The cylinders 42 and 45 are connected together in a closed loop (see FIG. 8) and are coordinated with each other such that the cylinder 42 is extended, as best shown in FIG. 1, to bring the wheel assemblies 4 inwardly, when the cylinder 45 is retracted (when the back support 48 is manually brought to a substantially horizontal position). The cylinder 42 is retracted to spread the wheel assemblies 4 apart, as best shown in FIG. 2, when the cylinder 45 is extended (when the back support 48 is manually brought to an upright position).

In addition to the back support 48, the platform structure 8 also includes a seat support 50 and a leg support 52 hingeably connected to the rails 29 in a manner as will be described below such that the platform support 8 can be positioned in a table configuration, as best shown in FIG. 1, or a chair configuration, as best shown in FIG. 2.

Referring to FIG. 4, the back support 48 includes an underlying board 54 supporting a split cushion 56. The board 54 is pivotably connected by a pair of brackets 58 which are in turn secured to the rails 29. The cylinders 46 are pivotably connected to the back board and to the rails 29. A pair of brackets 64 further connect the back board 54 to a linkage mechanism 66 that provides for the lowering of the leg support 52 to a substantially upright position when the back support 48 is raised to the upright position and to pull the seat support 50 rearwardly toward the center of the support structure when in the chair configuration.

The seat support 50 includes a cushion 68 supported by an underlying frame 70, which in turn is operably secured to the sliding rails 29.

The leg support 52 includes a cushion 72 supported by an underlying frame 74. A frame 76 is pivotably connected to the frame 74 and is in turn pivotably connected to the sliding rails 29 and to a pair of linkage arms 78.

The brackets 64 are connected to a pair of linkage arms 80, which are in turn pivotably connected to a pair linkage arms 82, and which are in turn connected to pair of linkage arms 83. The linkage arms 82 are pivotally connected at their intermediate portions to the sliding rails 29 at pivots 85. The other ends of the linkage arms 83 are pivotally connected to the stationary members 26 at pivots 87.

Figure 5:
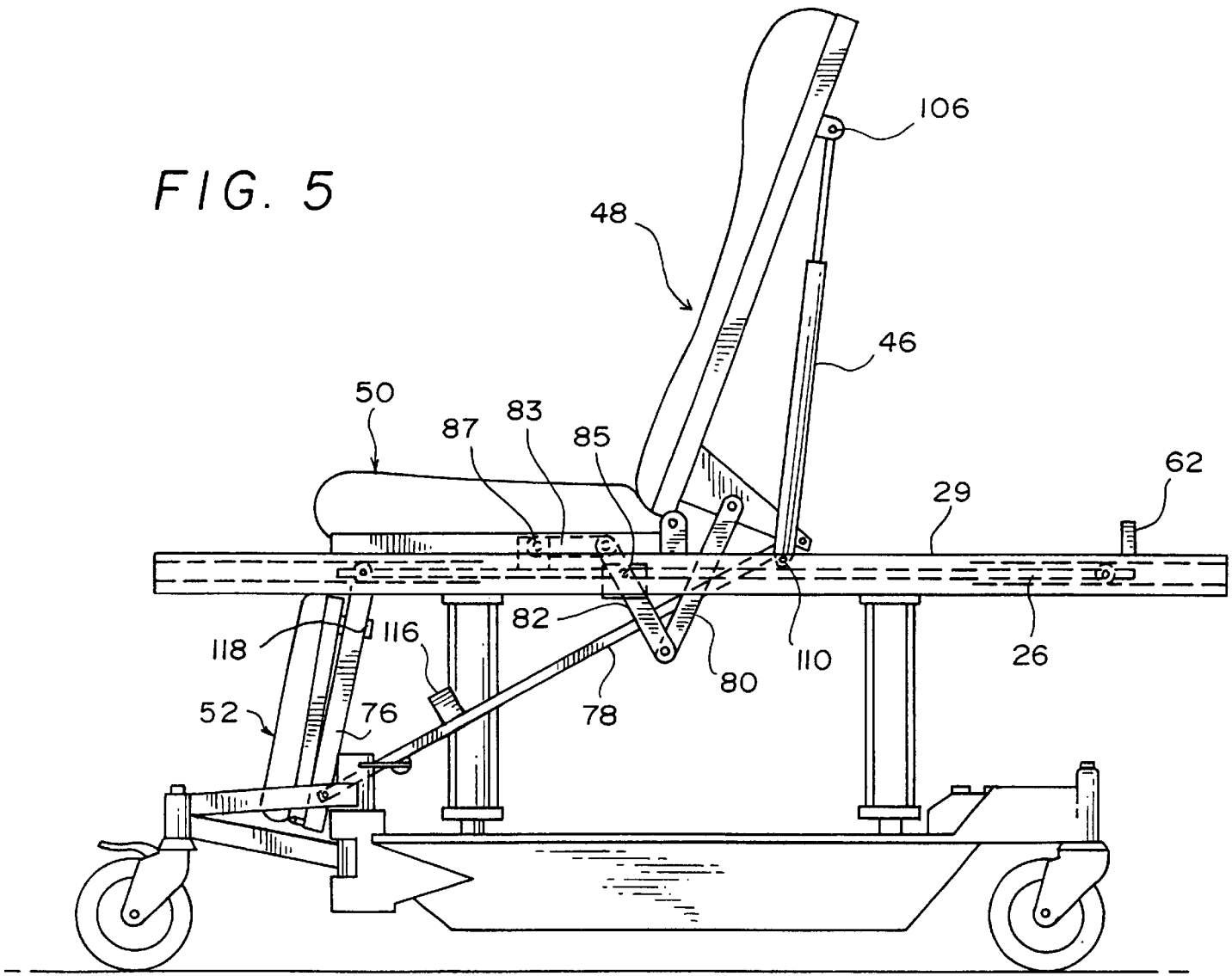
FIG. 5 is a left side elevational view of FIG. 2.

The linkage mechanism 66, as can be seen in FIG. 9, comprises the interconnected linkage arms 76, 78, 80, 82 and 83 and is effective to lower the leg support 52 in an upright position when the back support 48 is raised in the upright position. In addition, the linkage mechanism 66 pulls the seat support 50 towards the center of the support structure when the apparatus is changed to the chair configuration. Referring to FIGS. 4 and 5, when the back support is raised to the upright position, the distance between the pivots 85 and 87 increases, thereby causing the rails 29, which carry the seat support 50 (and the back support 48 and leg support 52), to move towards the rear.

Figures 3, 6:
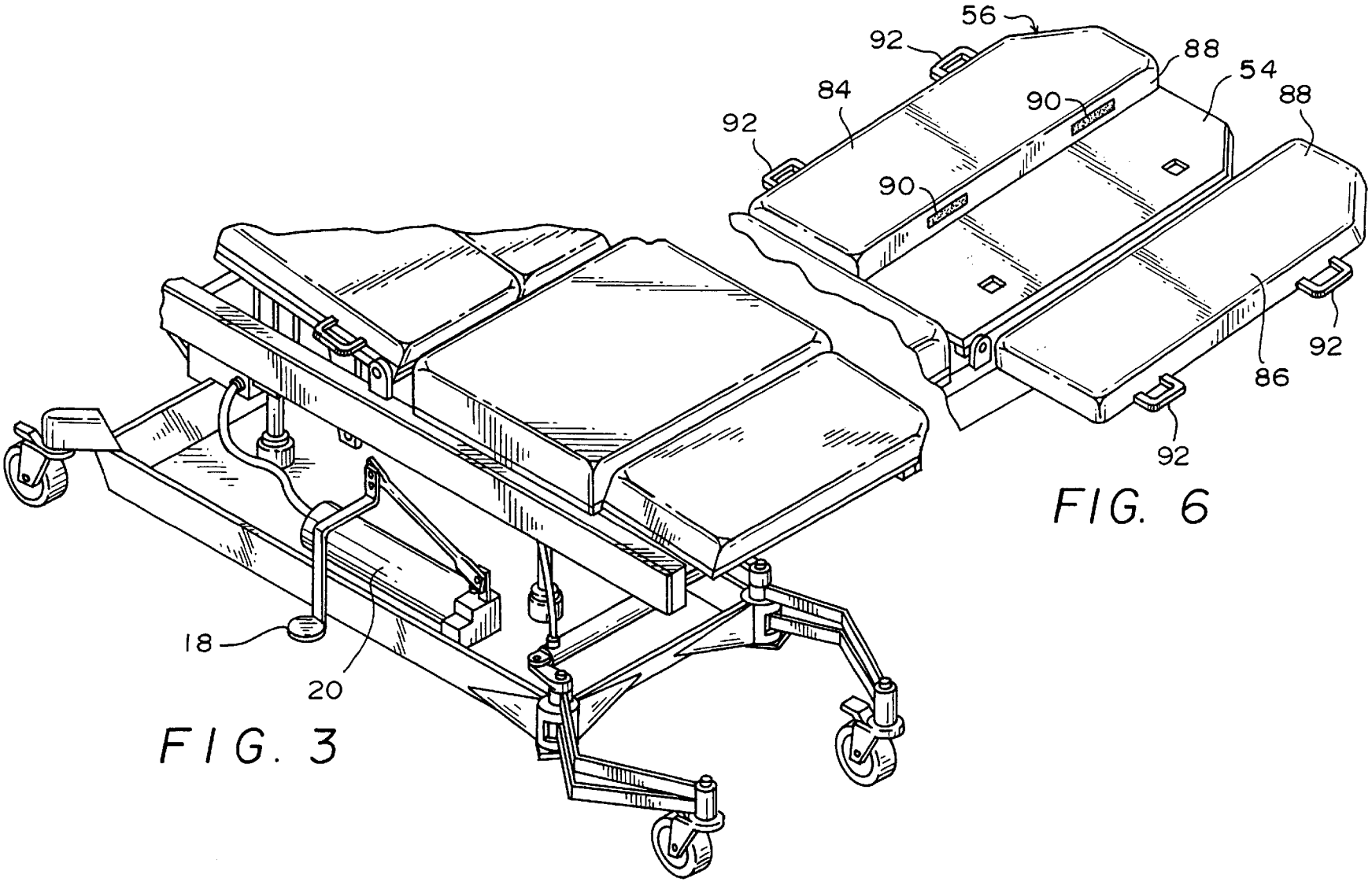
FIG. 3 is a partial perspective view of an opposite side of FIG. 1.
FIG. 6 is a perspective view of a split cushion used in the present invention.

Referring to FIG. 6, the split cushion 56 comprises cushion members 84 and 86 removably secured to each other along longitudinal sidewalls 88 by means of hook and loop fastener 90 or other standard means. The split cushions 56 are provided with handles 92 so that when the split cushions are desired to be separated from each other, a user on each side of the cushion can conveniently grab the handles 62 and pull in opposite directions. The split cushion 56 is advantageously used in a situation where a patient, lying in a horizontal position, requires a medical procedure, such as CPR, wherein a firm support is required underneath the patient. In such a case, the split cushion 56 is easily pulled from underneath the patient's upper body by grabbing the handles 92 and pulling in opposite directions, thereby exposing the backboard 54 to firmly support the upper body of the patient.

Referring to FIG. 7, the cylinder 45 is secured to stationary member 26 at pivot 94 and to sliding rail 29 at pivot 96. Sliding motion of the rail 29 relative to the rail 26 will cause the cylinder 45 to extend or retract, causing the front wheel cylinder 42 to retract or extend, respectively. The cylinder 45 is shown extended in FIG. 7.

Referring to FIG. 9, sliding motion of the rails 29 relative to the fixed members 26 is caused by the folding or unfolding of the linkage mechanism 66 when the back support 48 is raised manually to an upright position or lowered to a horizontal position. Referring to FIG. 4, the linkage mechanism 66 is shown in the folded position where the distance between the pivots 85 and 87 is smaller than when the linkage mechanism 66 is in the unfolded position, as shown in FIGS. 5 and 9.

Figure 10:
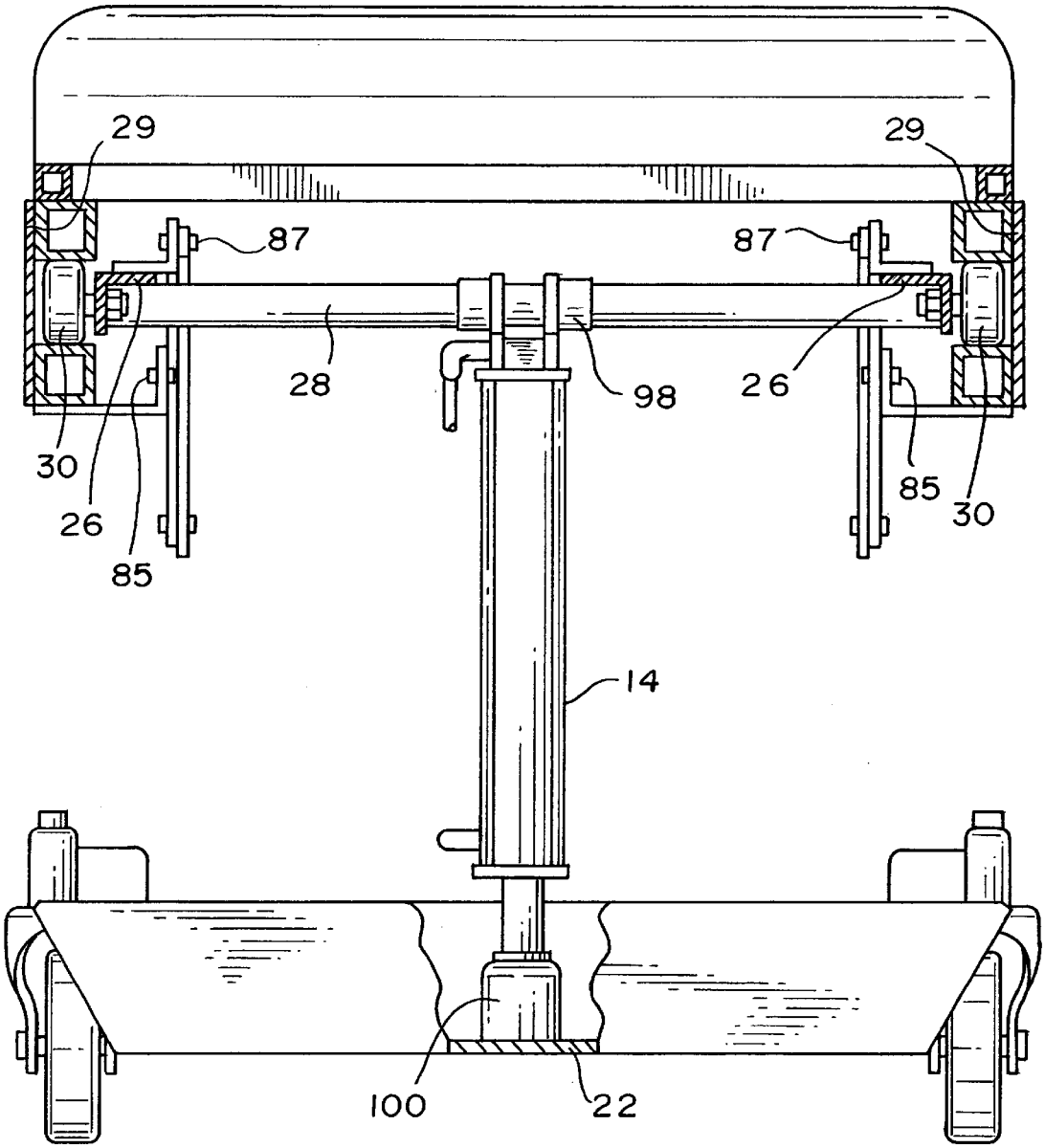

Referring to FIG. 10, the front cylinder 14 is connected to the front cross-member 28 with a swivel connector 98 and to the plate member 22 with a stationary, non-swiveling connector 100. Referring to FIGS. 2 and 11, the rear cylinder 14 is connected to the rear cross-member 28 and to the plate member 22 with swivel connectors 98 to permit differential lowering or raising of the front and rear portions of the platform structure 8.

Referring to FIGS. 5 and 12, the cylinders 46 are connected in a closed loop through a valve 102, which allows flow in both directions when open. Ends 104 are connected to the back support 48 with pivots 106. The other ends 108 are connected to the rails 29 with pivots 110. To raise the back support 48 from the horizontal to the upright position, the valve 102 is opened to allow the fluid within the cylinders 46 to flow to the other side of the cylinders to allow the piston rods to extend outwardly. When the valve 102 is closed, the back support 48 will remain in the upright position since the fluid within the cylinders would be prevented from flowing into the opposite ends of the cylinders. To lower the back support 48 to the horizontal position, the valve 102 is opened to allow the fluid to flow in the opposite direction. The cross-member 62 provides support to the back support 48 in the horizontal position.

Referring to FIGS. 4 and 5, the leg support 52 is hinged to the frame 76 at pivots 112. The frame 76 is connected to the rails 29 with pivots 114. When the apparatus is in the table configuration, the leg support 52 is substantially horizontal, as best shown in FIG. 4. A bracket 116 connected to the arm 78 pushes the leg support 52 to line up with the seat support 50. When the apparatus is in the chair configuration, the leg support 52 is substantially vertical and an angled bracket 118 catches the edge of the frame 76 and prevents the leg support 52 from falling forward.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. An apparatus convertible to a chair or table, comprising:

a) a support structure;

b) first and second pairs of wheels rotatably supporting said support structure;

c) a platform supported by said support structure, said platform including a seat support and a back support;

d) said platform being positionable between a chair configuration and a table configuration;

e) said first pair of wheels having inboard and outboard positions;

f) said first pair of wheels being automatically retracted to said inboard position when said platform is in said table configuration; and g) said first pair of wheels being automatically deployed to said outboard position when said platform is in said chair configuration.

2. An apparatus as in claim 1, wherein said platform is movable with respect to said support structure.

3. An apparatus as in claim 1, wherein said platform is movable backwardly when said first pair of wheels are in said outboard position.

4. An apparatus as in claim 1, wherein said platform is movable forwardly when said first pair of wheels are in said inboard position.

5. An apparatus as in claim 1, wherein said platform is movable upwardly or downwardly.

6. An apparatus as in claim 1, wherein said platform is tiltable.

7. An apparatus as in claim 1, wherein:

a) said back support includes a cushion;

b) said cushion includes first and second bodies separably secured to each other.

8. An apparatus as in claim 7, wherein said first and second bodies are separable along adjoining portions disposed along a longitudinal axis of said table configuration.

9. An apparatus as in claim 8, wherein said first and second bodies are joined by hook and loop fastener.

10. An apparatus as in claim 1, wherein:

a) said first pair of wheels includes respective arms extending from said support structure to respective wheels; and b) said arms are positioned laterally of said support structure in said outboard position.

11. An apparatus as in claim 10, wherein said arms are drawn inwardly toward each other when in said inboard position.

12. An apparatus as in claim 10, wherein:

a) a first cylinder to actuate said arms outwardly or inwardly;

b) a second cylinder which is actuated when said back support is raised to an upright position; and c) said first and second cylinders are operably connected to each other such that when said second cylinder is actuated to raise said back support to the upright position, said first cylinder is actuated to move said arms to said outboard position.

13. An apparatus as in claim 1, wherein:

a) said support structure includes a pair of parallel rails; and b) said platform is operably supported by said rails.

14. An apparatus as in claim 13, wherein said support structure includes first and second cylinders to raise or lower said rails.

15. An apparatus as in claim 14, wherein said first and second cylinders are selectively actuable to tilt said parallel rails toward the front or back.

16. An apparatus as in claim 14, wherein said first and second cylinders are operable at the same time to raise or lower said parallel rails.

17. An apparatus as in claim 1, wherein said platform includes a leg support movable between a substantially horizontal position and an upright position.

18. An apparatus as in claim 17, wherein said leg support is in said upright position when said platform is in said chair configuration.

19. An apparatus as in claim 17, wherein said leg support is in said substantially horizontal position when said platform is in said table configuration.

20. An apparatus convertible to a chair or table, comprising:

a) a support structure;

b) front and rear pairs of wheels rotatably supporting said support structure;

c) a platform supported by said support structure, said platform including a leg support, a seat support and a back support;

e) said seat support being disposed between said back support and said leg support;

d) said back support being movable between a substantially horizontal position and an upright position;

f) said leg support being movable between a substantially horizontal position and an upright position;

g) one of said front and rear wheels having an inboard position wherein the respective pair of wheels are at a first distance between each other and an outboard position wherein the respective pair of wheels are at a second distance between each other greater than said first distance;

h) said one of said front and rear pair of wheels being in said inboard position when said leg support and said back support are in said horizontal position; and i) said one of said front and rear pair of wheels being in said outboard position when said leg support and said back support are in said upright position.

21. An apparatus as in claim 20, wherein:

a) a linkage mechanism connected between said back support and said leg support to move said leg support to said upright position when said back support is moved to said upright position.

22. An apparatus convertible to a chair or table, comprising:

a) a support structure;

b) first and second pairs of wheels rotatably supporting said support structure;

c) a platform supported by said support structure, said platform including a seat support and a back support;

d) said platform being positionable between a chair configuration and a table configuration;

e) said seat support having a forward position or a rearward position when said platform is in said table or chair configuration, respectively;

f) said first pair of wheels having inboard and outboard positions from a longitudinal axis of said platform;

g) said first pair of wheels being in said inboard position when said platform is in said table configuration; and h) said first pair of wheels being in said outboard position when said platform is in said chair configuration.

23. An apparatus as in claim 22, wherein:

a) a pair of linkage arms operably connected to said back support and said seat support such that when said back support is raised to said upright position, said seat support is pulled rearwardly.

24. An apparatus as in claim 22, wherein:

a) said support structure includes a pair of parallel rails; and b) said seat support is movably supported by said pair of rails.

25. An apparatus convertible to a chair or table, comprising:

a) a support structure;

b) front and rear pairs of wheels rotatably supporting said support structure;

c) a platform supported by said support structure, said platform including a seat support and a back support;

d) said platform being positionable between a chair configuration and a table configuration;

e) said seat support being disposed between said front and rear pair of wheels; and f) said back support including first and second cushions separably secured to each other along adjoining portions disposed along a longitudinal axis of said table configuration.

26. An apparatus convertible to a chair or table, comprising:

a) a support structure;

b) first and second pairs of wheels rotatably supporting said support structure;

c) a platform supported by said support structure, said platform including a seat support and a back support;

d) said platform being positionable between a chair configuration and a table configuration;

e) said first pair of wheels having inboard and outboard positions;

f) said first pair of wheels being in said inboard position when said platform is in said table configuration;

g) said first pair of wheels being in said outboard position when said platform is in said chair configuration;

h) said first pair of wheels including respective arms extending from said support structure to respective wheels;

i) said arms are positioned laterally of said support structure in said outboard position;

j) a first cylinder to actuate said arms outwardly or inwardly;

k) a second cylinder which is actuated when said back support is raised to an upright position; and l) said first and second cylinders are operably connected to each other such that when said second cylinder is actuated to raise said back support to said upright position, said first cylinder is actuated to move said arms to said outboard position.

27. An apparatus convertible to a chair or table, comprising:

a) a support structure;

b) first and second pairs of wheels rotatably supporting said support structure;

c) a platform supported by said support structure, said platform including a seat support and a back support;

d) said platform being positionable between a chair configuration and a table configuration;

e) said first pair of wheels having inboard and outboard positions;

f) said first pair of wheels being in said inboard position when said platform is in said table configuration;

g) said first pair of wheels being in said outboard position when said platform is in said chair configuration;

h) said support structure including a pair of parallel rails;

i) said platform is operably supported by said rails; and j) said support structure including first and second cylinders to raise or lower said rails.

28. An apparatus as in claim 27, wherein said first and second cylinders are selectively actuatable to tilt said parallel rails toward the front or back.

29. An apparatus as in claim 27, wherein said first and second cylinders are operable at the same time to raise or lower said parallel rails.

* * * * *